US006766027B2

(12) United States Patent
Ryan et al.

(10) Patent No.: US 6,766,027 B2
(45) Date of Patent: Jul. 20, 2004

(54) ELLIPTICAL FLUSHMOUNT SPEAKER

(75) Inventors: Todd Ryan, San Clemente, CA (US); Ray Call, Mission Viejo, CA (US); Tommy Rucci, Oceanside, CA (US)

(73) Assignee: Dana Innovations, San Clemente, CA (US)

( * ) Notice: Subject to any disclaimer, the term of this patent is extended or adjusted under 35 U.S.C. 154(b) by 92 days.

(21) Appl. No.: 10/285,107

(22) Filed: Oct. 31, 2002

(65) Prior Publication Data

US 2004/0042627 A1 Mar. 4, 2004

Related U.S. Application Data

(63) Continuation-in-part of application No. 29/166,621, filed on Aug. 29, 2002.

(51) Int. Cl.[7] ..... H04R 25/00

(52) U.S. Cl. ..... 381/182; 381/186; 381/386; 381/387; 381/433; 381/423; 381/424; 181/144; 181/219; 181/153; 181/154; 181/163; 181/179; 181/186

(58) Field of Search ..... 381/182, 386, 381/387, 186, 395, 433, 424, 432, 300, 181, 184, 389; 181/144, 145, 147, 153, 154, 163, 171, 173, 179, 186, 197, 219

(56) References Cited

U.S. PATENT DOCUMENTS

| | | | | | |
|---|---|---|---|---|---|
| 2,053,364 | A | * | 9/1936 | Engholm | 381/186 |
| 2,857,478 | A | * | 10/1958 | Harris | 381/182 |
| 3,754,618 | A | * | 8/1973 | Sasaki | 181/145 |
| 3,796,839 | A | * | 3/1974 | Torn | 381/182 |
| 4,182,429 | A | * | 1/1980 | Senzaki | 181/144 |
| D254,434 | S | | 3/1980 | Iijima | |
| D261,642 | S | | 11/1981 | Babb | |
| 4,365,114 | A | * | 12/1982 | Soma | 381/182 |
| D280,818 | S | | 10/1985 | Clover, Jr. | |
| 4,554,414 | A | * | 11/1985 | House | 381/182 |
| 4,565,905 | A | * | 1/1986 | Nation | 381/186 |
| 4,672,675 | A | * | 6/1987 | Powell et al. | 381/182 |
| 4,811,406 | A | * | 3/1989 | Kawachi | 381/186 |
| 4,837,829 | A | * | 6/1989 | Lobb | 381/83 |
| 4,837,839 | A | | 6/1989 | Andrews | |
| D302,556 | S | | 8/1989 | Weissberg et al. | |
| 5,133,428 | A | * | 7/1992 | Perrson | 181/153 |
| 5,512,714 | A | * | 4/1996 | Fenton | 181/144 |
| 5,568,562 | A | * | 10/1996 | Huang | 381/186 |
| 5,629,501 | A | * | 5/1997 | Fenton | 381/186 |
| 5,635,686 | A | * | 6/1997 | Fenton | 181/144 |
| 6,081,602 | A | * | 6/2000 | Meyer et al. | 381/99 |
| 6,134,332 | A | * | 10/2000 | Wiener | 381/160 |
| 6,282,297 | B1 | * | 8/2001 | Lin | 381/386 |
| 6,356,640 | B1 | * | 3/2002 | Lin | 381/182 |
| 6,493,452 | B1 | * | 12/2002 | Koizumi et al. | 381/182 |
| 6,625,289 | B1 | * | 9/2003 | Oliemuller | 381/182 |

* cited by examiner

*Primary Examiner*—Curtis Kuntz
*Assistant Examiner*—Dionne N. Harvey
(74) *Attorney, Agent, or Firm*—Stetina Brunda Garred & Brucker

(57) ABSTRACT

An elliptical speaker system is provided for in-wall/in-ceiling mounting. The speaker system comprises an elliptical speaker frame or bracket defining a speaker front plane having a generally arcuate inner surface. First and second speaker components are mounted within the speaker frame, on opposing sides of the speaker inner surface. At least one of the speaker components may be translatable within the speaker frame.

9 Claims, 4 Drawing Sheets

ELLIPTICAL FLUSHMOUNT SPEAKER

CROSS-REFERENCE TO RELATED APPLICATIONS

This is a continuation-in-part of application Ser. No. 29/166,621 filed on Aug. 29, 2002.

FIELD OF THE INVENTION

BACKGROUND OF THE INVENTION

The present invention relates to in-wall and in-ceiling type speaker systems and, more particularly, to three-way speaker systems having adjustable speaker components.

In-wall speaker systems have revolved from crude intercom systems to the more high fidelity systems currently available today. Such speaker systems are adapted for flush mounting in walls or ceilings, and may be supported in various ways. In some cases the speaker systems are installed during the initial construction of the structure, and may be secured to beams or other structural members within a wall or ceiling. In other cases, such speaker systems may be retrofit to existing walls or ceilings, whereupon they may utilize different types of mechanisms for maintaining their position in the wall or ceiling.

Despite the flexibility of current in-wall speaker systems, there are circumstances where the installation location may be limited by structural members, electrical wiring, or other circumstances that may preclude locating the speaker in the most desirable position in relation to the listening audience. In such circumstances, it is desirable to be able to translate speaker portions so that they may be aimed more specifically to the prime listening area. Such translation is particularly significant in relation to mid frequency and high frequency speakers, which are more dependent upon proper directional orientation. Contemporary products have been developed which permit such translation of the mid frequency and high frequency components in high quality in-wall/in-ceiling speaker systems. One such system is the Virtuoso™ speaker system marketed by Sonance, which includes a Sonic-Eye™ module that permits translation of a combined mid frequency/high frequency speaker.

Such translatable speaker systems commonly allow the speaker components to be translated in the range of 20 degrees from a plane normal to the speaker surface. That range is typically effective to direct side speakers and rear speakers to the prime listening area to achieve a surround sound effect in the listening area.

Center speaker channels of a surround sound system typically consist of a high quality three-way speaker system that is directly aimed at the prime listening area. The center channel speaker system is commonly spaced from the rear channels such that the sounds from the center and rear channels are discrete, to facilitate a more lifelike surround sound.

In many cases a center channel speaker may be a box enclosure located above a television system. Such box speakers are frequently used, even where the side and rear channels are in-wall or in-ceiling speakers. One reason for the use of such box speakers, with other in-wall speaker systems, concerns the limitations on the translation of conventional in-wall/in-ceiling speakers. As mentioned above, such translatable systems commonly allow translation of the speaker components in the range of 20 degrees from the plane normal to the speaker. Therefore, assuming a conventional 8 foot ceiling, conventional in-ceiling speaker systems having translatable components would still need to be located only a few feet in front of the prime listening area in order to have the translatable speakers directed at the prime listening area. However, the television system may commonly be located at least 10 to 12 feet from the prime listening area, particularly where the television system is a projection system. As such, the directionality of the sound from the center channel system is significantly displaced from the directionality of the television, and may be only marginally discrete from the sound from the side or rear channels.

Accordingly, it would be desirable to provide an in-wall/in-ceiling speaker system wherein the center channel speaker can be located more forward of the listening area, while maintaining a focus on the prime listening area. Additionally, it would be desirable to provide such a speaker system that is compact for easy installation, while avoiding the need to angle the speakers towards the speaker frame.

These and other objects and advantages are achieved in the novel in-wall/in-ceiling speaker system disclosed and illustrated herein. As set forth more fully below, the present invention provides a three-way speaker system that may be utilized for any channel for a surround sound speaker system, including a center channel. The system described herein provides a compact speaker system that may be disposed significantly forward of the listening area, while still directed towards the listening area, without the need to angle the speakers towards the speaker frame, causing interference to the directionality of the sound.

BRIEF SUMMARY OF THE INVENTION

An elliptical speaker system is provided for in-wall/in-ceiling mounting. The speaker system comprises an elliptical speaker frame defining a speaker front plane having a generally arcuate inner surface. First and second speaker components are mounted within the speaker frame, on opposing sides of the speaker inner surface. At least one of the speaker components may be translatable within the speaker frame.

In the presently preferred embodiment a first speaker component is implemented as a woofer speaker, and the second speaker component includes tweeter and midrange speakers. The tweeter and midrange speakers may be disposed within a tweeter/midrange speaker module, that translates within the speaker frame.

In the presently preferred embodiment the tweeter/midrange speaker module defines a tweeter/midrange center sound axis, which normally exits the speaker frame at an angle of approximately 60° with respect to the speaker front plane. The tweeter/midrange speaker module may be translatable of approximately 20° about the tweeter/midrange center axis, i.e. 60°±20° with respect to the speaker front plane. As a consequence, the tweeter/midrange module may be directed to the prime listening area from a location proximate a video source.

In the presently preferred embodiment the woofer speaker defines a center sound axis which exits the speaker frame at an angle of approximately 30° with respect to the speaker front plane. In the disclosed embodiment, the woofer speaker is in a fixed orientation relative to the speaker frame, though in alternate embodiments the woofer speaker may also be translatable in relation to the speaker frame.

BRIEF DESCRIPTION OF THE DRAWINGS

These as well as other features of the present invention will become more apparent upon reference to the drawings wherein.

DETAILED DESCRIPTION OF THE PRESENTLY PREFERRED EMBODIMENT

Figure 1:
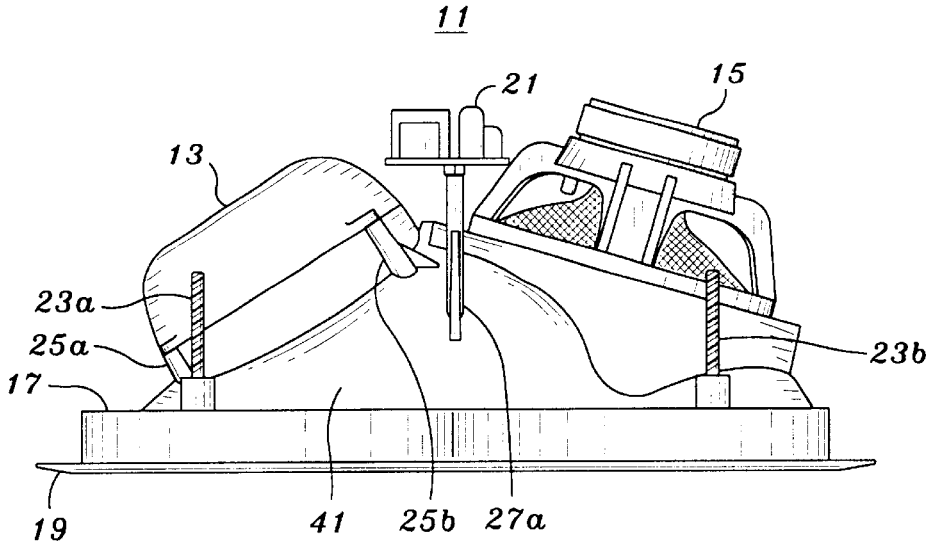
FIG. 1 is a front view of a speaker system in accordance with the present invention.

The present invention is described below in connection with the illustrated embodiment. However, it is to be understood that the embodiment shown is exemplary and may be modified to accommodate different components, structures, and functionalities without the departing from the broader aspects of the invention as described herein.

The construction of a speaker system formed in accordance with the present invention is illustrated at FIGS. 1–7. As shown therein the speaker system 11 includes a pair of speaker components mounted on opposing sides of the speaker inner surface, i.e. tweeter/midrange speaker module 13 and woofer 15, secured to speaker frame or bracket 17 and oriented toward each other. Crossover network 21 is mounted on frame 17 via support bosses 27*a*, 27*b*.

The frame 17 is shaped as an ellipse, and may be formed as a single piece of plastic material including baffle 19, which defines the front plane of speaker 11, Baffle 19 abuts against the wall or ceiling in which the speaker 11 is mounted. The speaker frame 17 defines egg shaped front or inner surface 43 and a rear surface 41, through which apertures 47, 49 are formed to receive the tweeter/midrange module 13 and woofer 15, respectively. In the presently preferred embodiment the inner surface 43 defines an opening of approximately 14 inches long and 8 inches wide.

Figure 7:
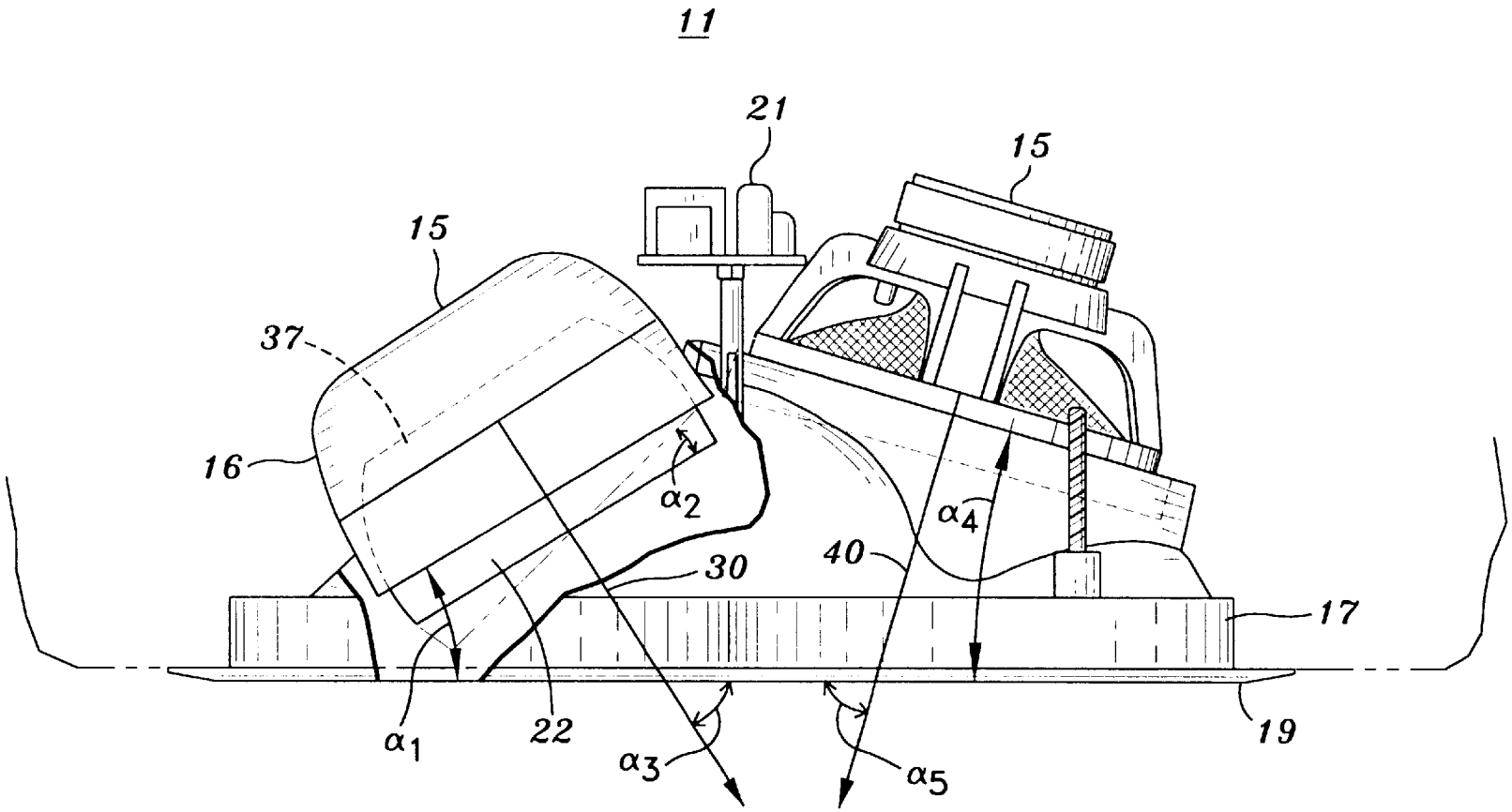
FIG. 7 is a cut away front view of the speaker system.

The tweeter/midrange module 13 may be implemented as the tweeter/midrange array marketed by Sonance as the Sonic-Eye™ two-way speaker module, a highly accurate, enclosed driver array with controlled dispersion to allow the tweeter speaker and midrange speaker to jointly pivot up to 20 degrees with respect to the tweeter/midrange module center line 30, as shown at FIG. 7. Such a module is further disclosed in U.S. patent application Ser. No. 10/038,492 for 3-Way Speaker System Having Translatable Mid-Range/Tweeter Module, the substance of which is incorporated by reference herein.

Figure 2:
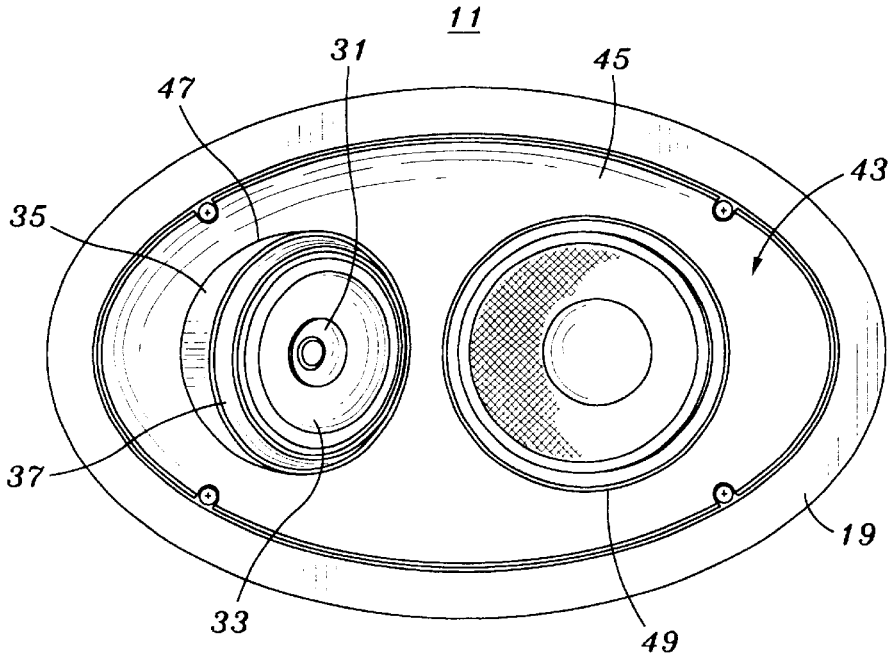
FIG. 2 is a top view of the speaker system.
Figure 3:
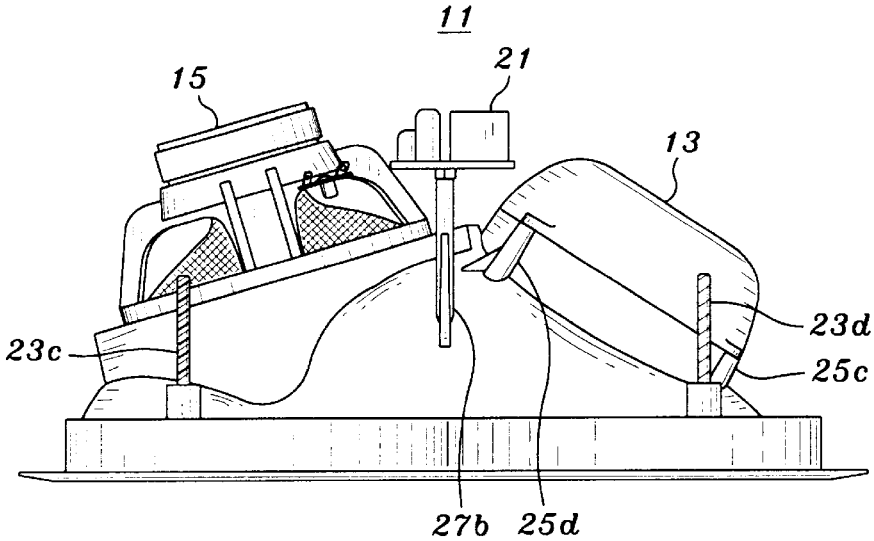
FIG. 3 is a rear view of the speaker system.
Figure 4:
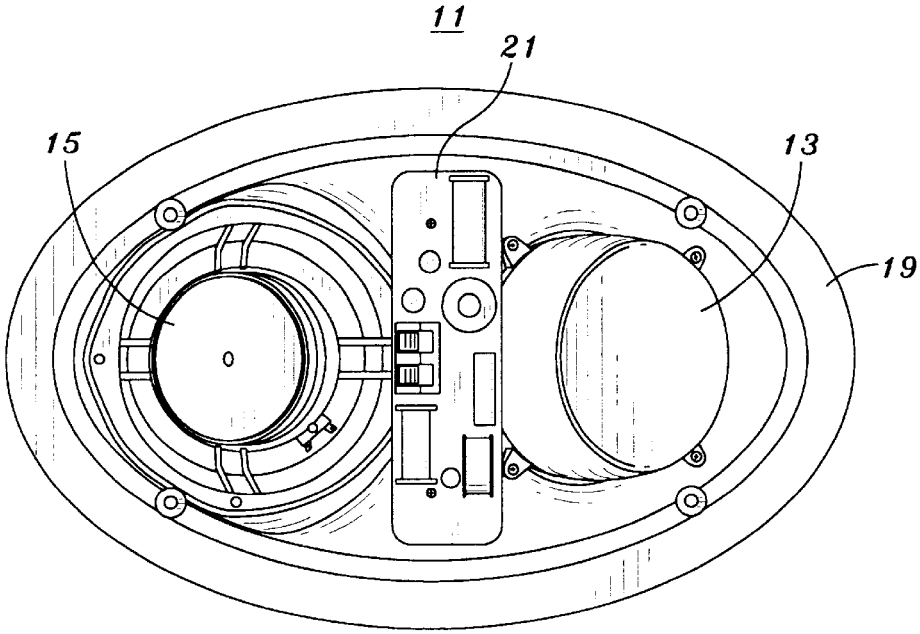
FIG. 4 is a bottom view of the speaker system.
Figure 5:
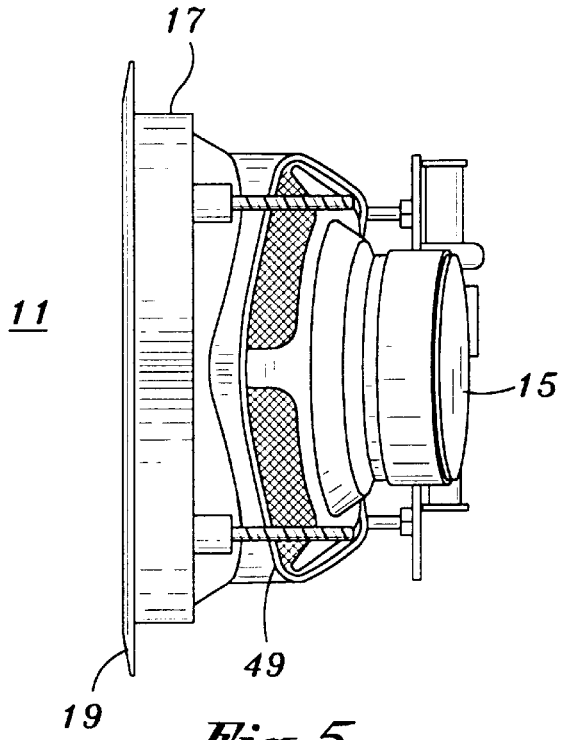
FIG. 5 is a first end view of the speaker system.
Figure 6:
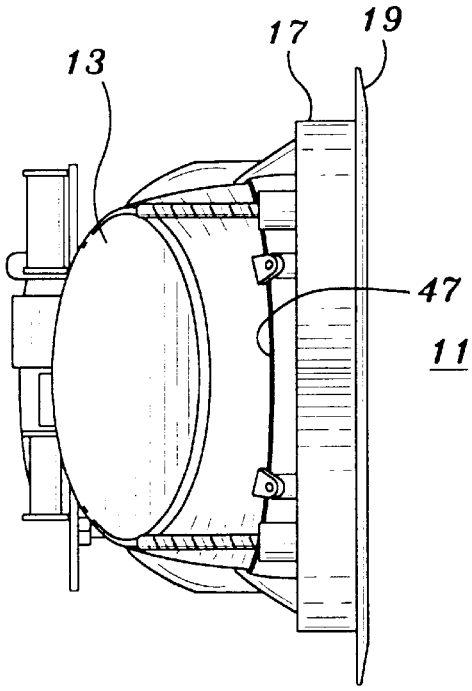
FIG. 6 is a second end view of the speaker system.

The tweeter/mid-range module 13 is supported within the frame 17 by support bosses 25*a, b, c, d*. As shown in FIGS. 1, 2, the tweeter/midrange module 13 includes a translatable, or pivotal collar 37 mounted within housing 35, which extends through frame aperture 47. Tweeter speaker 31 and midrange speaker 33, are mounted on collar 37, and jointly translate with collar 37.

In the presently preferred embodiment, tweeter 31 may be implemented as a one-half (½) inch cloth dome pivoting tweeter. Midrange speaker 33 may be implemented as a four (4) inch polypropylene cone pivoting midrange speaker. Woofer 15 may be implemented as a six and one-half (6½) inch woven composite glass cone woofer, capable of reproducing bass down to approximately 50 Hz, allowing for an extremely low crossover point from the tweeter/midrange module to the subwoofer.

The crossover module 21 may be implemented using high quality crossover circuitry such as that provided on the Virtuoso RS2 speaker systems marketed by Sonance.

The speaker system 11 may be mounted to a wall or ceiling using fasteners 23*a, b, c, d* which engage and extend through frame 17. The fasteners 23*a, b, c, d*, may engage support brackets to secure the speaker 11 to the mounting surface, such as the FlexBar mounting brackets marketed by Sonance. Alternatively, the speaker 11 may be mounted to the wall or ceiling by use of other standard accessories, such as the acoustical enclosure or staple template, marketed by Sonance.

FIG. 7 illustrates the advantageous directionality of sound produced by the speaker system 11. As shown therein tweeter/midrange module 13 tweeter includes pivoting collar 37, which supports the tweeter 31 and midrange speaker 33. Module 15 and collar 37 are normally mounted within frame 17 at an angle, $\propto_1$, in relation to the speaker front plane 19. In the presently preferred embodiment $\propto_1$ is approximately 30 degrees.

Collar 37 pivots within module 15 at an angle $\propto_2$. In the presently preferred embodiment, utilizing the Sonance Sonic-Eye module, the collar 37 is constructed to pivot ±20 degrees from its center orientation, as defined by module center sound line 30. The collar 37, including tweeter 31 and midrange speaker 33 define the center sound line 30 which exits speaker frame 17 at an angle $\propto_3$ of approximately 60 degrees relative to the front plane 19. The center sound line 30 will translate with movement of collar 37, such that the center sound line may vary ±20 degrees. As a result, the center sound line may exit the speaker frame at an angle of between 40 to 80 degrees with respect to speaker front plane 19, i.e. 60°±20°. The speaker frame surfaces 41, 43 are sized and arranged such that the center line 30 exits the speaker frame 17 without impacting any portion of the frame 17. Moreover, in the presently preferred embodiment the collar 37 may pivot over its entire range of 20 degrees such that no line normal to any portion of the front surface of collar 37 impacts any portion of the speaker frame 17.

Woofer 15 is oriented at angle $\propto_4$ in relation to the plane of bezzle 19. In the presently preferred embodiment $\propto_4$ is approximately 20 degrees. Woofer 15 defines a woofer center sound line 40, which exits the speaker frame at an angle $\propto_5$, with respect to speaker front plane 19. In the preferred embodiment angle $\propto_5$ is approximately 70°.

In accordance with the present invention the tweeter/midrange module 15 may be oriented such that the speaker system 11 can be sufficiently spaced from the prime listening area to serve as a discreet sound source, without destructive interference arising from the frame 17. As such, the speaker system 11 may serve as a high quality in-wall/in-ceiling speaker, suitable for use as a center channel speaker system in a surround sound audio system.

As one of ordinary skill will recognize, the orientation of woofer 15, which may be away from the prime listening area, will not significantly detract from audio performance, insofar as the bass audio signals emitted are significantly less directional in acoustical perception.

As shown in the illustrated embodiment, the woofer speaker is in a fixed orientation relative to the speaker frame. However, as will be recognized by those skilled in the art, alternative implementations of the invention allow for use of a pivoting woofer 15, in addition to the pivoting tweeter/midrange module 13.

Other modifications may also be implemented within the broader aspects of the invention, as disclosed herein.

What is claimed is:

1. An eilliptical speaker system for in-wall/in-ceiling mounting, the system comprising: an elliptical mounting bracket defining a concaved inner surface; and first and second speaker components at least partially facing each other on the concaved inner surface; wherein the first speaker component is a woofer speaker, and the second speaker component includes a tweeter speaker and a midrange speaker; and wherein the tweeter speaker is mounted in the center of the midrange speaker.

2. The speaker system as recited in claim 1 wherein the tweeter speaker and the midrange speaker are translatable within the speaker frame.

3. The speaker system as recited in claim 2 wherein the tweeter speaker and the midrange speaker are disposed within a tweeter/midrange speaker module.

4. The speaker system as recited in claim 3 wherein the tweeter speaker and the midrange speaker are jointly translatable within the tweeter/midrange speaker module.

5. The speaker system as recited in claim 4 wherein the tweeter/midrange speaker module defines a tweeter/midrange center sound axis, which normally exits the speaker bracket at an angle of approximately 60° with respect to the speaker front plane.

6. The speaker system as recited in claim 5 wherein the tweeter/midrange speaker module is translatable approximately 20 degrees about the tweeter/midrange center sound axis.

7. The speaker system as recited in claim 6 wherein the woofer speaker defines a woofer center sound axis, the woofer center sound axis exiting the speaker bracket at an angle of approximately 30° with respect to the speaker front plane.

8. The speaker system as recited in claim 7 wherein the speaker inner surface is generally egg shaped.

9. The speaker system as recited in claim 4 wherein the first and second speaker components are oriented towards each other.

* * * * *